US007637757B2

(12) United States Patent
Matsumura et al.

(10) Patent No.: US 7,637,757 B2
(45) Date of Patent: Dec. 29, 2009

(54) LEVER FITTING TYPE CONNECTOR

(75) Inventors: Kaoru Matsumura, Makinohara (JP); Akihiro Tsuruta, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/362,653

(22) Filed: Jan. 30, 2009

(65) Prior Publication Data

US 2009/0203241 A1 Aug. 13, 2009

(30) Foreign Application Priority Data

Feb. 8, 2008 (JP) ..... 2008-028604

(51) Int. Cl.
*H01R 13/62* (2006.01)

(52) U.S. Cl. ..... 439/157

(58) Field of Classification Search ..... 439/157, 439/160, 357, 372

See application file for complete search history.

(56) References Cited

U.S. PATENT DOCUMENTS 6,176,713 B1 * 1/2001 Okabe ..... 439/157
6,213,794 B1 * 4/2001 Okabe et al. ..... 439/157
6,402,534 B2 * 6/2002 Okabe et al. ..... 439/157
6,656,037 B2 * 12/2003 Matsushita ..... 439/544
7,445,475 B2 * 11/2008 Tajiri et al. ..... 439/157

FOREIGN PATENT DOCUMENTS

JP 11-31551 A 2/1999
JP 2000-91026 A 3/2000

* cited by examiner

*Primary Examiner*—Michael C Zarroli
(74) *Attorney, Agent, or Firm*—Sughrue Mion, PLLC

(57) ABSTRACT

A lever fitting type connector includes a male connector having a temporary-retaining convex portion, a lever having a temporary-retaining portion, and a female connector having a fitting space. An inner wall forming the fitting space has a guiding groove portion and a receiving groove portion and has a release portion. When the fulcrum projection is located in the guide groove portion at the initial process of the fitting operation, a clearance represented by X is formed between the fulcrum projection and an edge wall of the guide groove portion, and a clearance represented by Y is formed between the temporary-retaining portion and the temporary-retaining convex portion, and the formula, ($X \times b < Y \times a$), is established where a represents the distance between an axis of rotation movement of the lever and the fulcrum projection, and b represents the distance between the axis of rotation movement of the lever and the temporary-retaining portion.

1 Claim, 6 Drawing Sheets

LEVER FITTING TYPE CONNECTOR

BACKGROUND

This invention relates to a lever fitting type connector in which by pivotally moving a lever mounted on a male connector, the male connector is moved between a fitted position where the male connector is fitted in a female connector and a non-fitted position where the male connector is not fitted in the female connector.

For bringing a pair of male and female connectors (having multi-pole terminals) into and out of fitting connection with each other, there has heretofore been used a lever fitting type connector in which a manipulating force is reduced by the use of a lever (see, for example, Patent Literature 1).

Such a lever fitting type connector is shown in FIG. 6. The lever fitting type connector 100 shown in FIG. 6 comprises a male connector 102 connected to ends of wires 104, a lever 101 having boss portion-receiving holes 111*a* and 111*b* (formed in a center portion thereof) receiving boss portions 121*a* and 121*b* formed on opposite side faces of the male connector 102, and a female connector 103 having a fitting space for the insertion of the male connector 102 therein.

The lever 101 includes a pair of side plates superposed respectively on the opposite side faces of the male connector 102, and a manipulating portion 114 interconnecting distal end portions of the pair of side plates. Each of the side plates includes the boss portion-receiving holes 111*a* and 111*b* formed in its center portion and receiving the respective boss portions 121*a* and 121*b*, a fulcrum projection 112 formed on its proximal end portion and serving as a fulcrum for rotation movement of the lever, and a temporary-retaining piece portion 113 formed at the lower side of its distal end portion. At an initial stage of the fitting operation, each temporary-retaining piece portion 113 is located in a position where it is spaced from a temporary-retaining convex portion 122 (formed on and projecting from a side face of the male connector 102) in a direction away from the female connector 103, thereby disenabling the rotation movement of the lever 101 toward the female connector 103.

The female connector 103 includes a female connector housing having the above-mentioned fitting space. Two fulcrum projection guide grooves 136 are formed in an inner surface (or inner wall) of the female connector housing defining the fitting space, and extend from an upper end of the inner surface to an inner part of the fitting space. Also, fulcrum projection-receiving grooves 137 are formed in the inner surface of the female connector housing, and extend from the respective fulcrum projection guide grooves 136 in intersecting relation thereto. Further, plate-like release plate portions 135 are formed at the inner surface of the female connector housing.

Each fulcrum projection-receiving groove 137 receives the corresponding fulcrum projection 112 therein at the time of rotation movement of the lever 101, and enables this fulcrum projection 112 to serve as a fulcrum for the lever 101. Each fulcrum projection guide groove 136 is a groove through which the fulcrum projection 112 is moved into the fulcrum projection-receiving groove 137. Namely, the fulcrum projection guide groove 136 guides the fulcrum projection 112 to the fulcrum projection-receiving groove 137.

When the male connector 102 is moved toward the female connector 103, each release plate portion 135 is brought into contact with the inner side of the corresponding temporary-retaining piece portion 113 to elastically bend this temporary-retaining piece portion 113 outwardly, and causes the temporary-retaining piece portion 113 to slide over the temporary-retaining convex portion 122 toward the female connector 103. When each temporary-retaining piece portion 113 thus slides over the temporary-retaining convex portion 122, a rotation movement-disenabling condition of the lever 101 is canceled.

In the above lever fitting type connector 100, each fulcrum projection 112 passes through the fulcrum projection guide groove 136 as shown in FIG. 6A, and then is located in the fulcrum projection-receiving groove 137. In this condition, the manipulating portion 114 is pressed toward the female connector 103, thereby pivotally moving the lever 101, and as a result the male connector 102 is pressed to be moved toward the inner part of the fitting space and is fitted in the female connector 103, with the fulcrum projections 112 serving as the fulcrum and also with the boss portion-receiving holes 111*a* and 111*b* serving as a point of application. Simultaneously when this fitting operation is effected, a lock arm (not shown) formed on the lever 101 is retainingly engaged with the female connector 103, thereby preventing the lever 101 from being moved even upon application of an accidental external force to the lever 101. In this lever fitting type connector 100, by pressing the manipulating portion 114 in the direction away from the female connector 103, the fitted condition can be canceled.

[Patent Literature 1] JP-A-2000-91026

In the above lever fitting type connector 100, the male connector 102 and the female connector 103 were sometimes kept in a half-fitted condition for some reason as shown in FIG. 6B. When the wires 104 (connected to the male connector 102) were pulled in order to cancel this half-fitted condition so as to return the lever fitting type connector into a condition in which terminals of the connector 102 were electrically disconnected respectively from terminals of the connector 103, there was sometimes encountered a problem that each temporary-retaining piece 113 failed to be returned beyond the temporary-retaining convex portion 122 in the direction away from the female connector 103 as shown in FIG. 6C. In this condition, when the manipulating portion 114 was again pressed so as to effect the fitting operation, the lever 101 began to be pivotally moved earlier than a predetermined timing, which resulted in a problem that the male connector 102 could not be fitted into the female connector 103. The term "half-fitted condition" means a condition in which the terminals of the male connector 102 are electrically connected to the respective terminals of the female connector 103, and also the lock arm is not retainingly engaged with the female connector 103.

The inventors of the present invention have studied the cause of the above problem, and have found the following. Namely, in the half-fitted condition of the lever fitting type connector 100, when the manipulating portion 114 is pressed in the direction away from the female connector 103, the lever 101 is pivotally moved, with an outer edge portion of the fulcrum projection 112 abutting against an edge wall 138 of the fulcrum projection-receiving groove 137, and at this time the fulcrum projection 112 is moved from the fulcrum projection-receiving groove 137 into the fulcrum projection guide groove 136. Therefore, in this condition in which the fulcrum projection 112 is located in the fulcrum projection-receiving groove 136, the temporary-retaining piece 113 is returned to the position where it is spaced from the temporary-retaining convex portion 122 in the direction away from the female connector 103. However, when trying to cancel the above half-fitted condition by pulling the wires 104 of the male connector 102 as described above, there is sometimes encountered a situation in which the outer edge portion of the fulcrum projection 112 does not abut against the edge wall 138, and the fulcrum projection 112 is moved from the fulcrum projection-receiving groove 137 into the fulcrum projection guide groove 136 without rotation movement of the lever 101. Therefore, although the fulcrum projection 112 is thus located in the fulcrum projection-receiving groove 136, the temporary-retaining piece 113 fails to be returned to the position where it is spaced from the temporary-retaining convex portion 122 in the direction away from the female connector 103. This fact has been found.

As described above, when trying to cancel the above half-fitted condition by pulling the wires 104, there is sometimes encountered the situation in which an angular portion (or corner portion) 112*a* of the fulcrum projection 112 (that is, that portion of the fulcrum projection 112 which is located nearest to the proximal end portion of the lever 101, and has a gently-angular shape in a plan view, and is first brought into abutting engagement with the edge wall 138 when the lever 101 is pivotally moved) does not abut against the edge wall 138, and the fulcrum projection 112 is moved from the fulcrum projection-receiving groove 137 into the fulcrum projection guide groove 136 without rotation movement of the lever 101. It has been found that this situation is caused by a clearance formed between the angular portion 112*a* and an edge wall 139 of the fulcrum projection-receiving groove 136.

SUMMARY

Therefore, it is an object of this invention to provide a lever fitting type connector in which even when a half-fitted condition of male and female connectors is canceled by any means, a lever can be returned into a rotation movement-disenabling condition without fail.

In order to achieve the above object, according to the present invention, there is provided a lever fitting type connector, comprising:

a male connector;

a lever which is rotatably attached to the male connector; and a female connector which has a fitting space into which the male connector is inserted, wherein an inner wall forming the fitting space of the female connector has a guiding groove portion and a receiving groove portion for receiving a fulcrum projection formed at one end portion of the lever;

wherein when the lever is rotatably moved by pressing a manipulating portion at the other end portion of the lever toward the female connector in a condition that the fulcrum projection is located in the receiving groove portion, the male connector is pressed into the inside of the fitting space in a fitting direction to be fitted into the female connector, with the fulcrum projection serving as a fulcrum and with a center portion serving as an action point;

wherein when the manipulating portion is pressed so as to be away from the female connector or wires connected to the male connector are pulled in a half-fitted condition of the lever fitting type connector, the lever fitting type connector is returned into a non-fitted condition in which terminals of the male connector are not electrically connected to terminals of the female connector;

wherein the guiding groove portion extends in the fitting direction from an upper end portion of the inner wall toward the inside of the fitting space;

wherein the receiving groove portion is communicated with the guiding groove portion and extends in a direction intersecting the fitting direction from one end of the guiding groove portion which is away from the upper portion of the inner wall;

wherein a temporary-retaining portion is formed on the lever, and a temporary-retaining convex portion is formed on the side face of the male connector, and at an initial process of the fitting operation, the temporary-retaining portion is spaced from the temporary-retaining convex portion in a direction away from the female connector for restricting the rotation movement of the lever toward the female connector;

wherein a release portion is formed on the inner wall, and when the male connector is moved toward the female connector, the release portion is brought into contact with an inner side of the temporary-retaining portion to bend the temporary-retaining portion outwardly so that the temporary-retaining portion slide over the temporary-retaining convex portion toward the female connector to release an unrotatable condition of the lever; and wherein in a condition in which the fulcrum projection is located in the guide groove portion at the initial process of the fitting operation, a clearance represented by X is formed between the fulcrum projection and an edge wall of the guide groove portion disposed close to the receiving groove portion, and a clearance represented by Y is formed between the temporary-retaining portion and the temporary-retaining convex portion, and the formula, ($X \times b < Y \times a$), is established where a represents the distance between an axis of rotation movement of the lever and the fulcrum projection, and b represents the distance between the axis of rotation movement of the lever and the temporary-retaining portion.

For example, in a lever fitting type connector 10 shown in FIG. 5, at an initial process of the fitting operation, a male connector 2 and a lever 1 (mounted on this male connector 2 and kept in a rotation movement-disenabling condition) are inserted into a fitting space of a female connector 3 through an opening thereof, and also a fulcrum projection 12 is passed to a lower end of a fulcrum projection guide groove 36 through an upper end thereof. At this time, the fulcrum projection 12 is passed, with a clearance X formed between its angular portion 12*a* and an edge wall 39 of the fulcrum projection guide groove 36. At this time, the lever 1 is located such that a temporary-retaining piece portion 13 is located in a position where it is spaced from a temporary-retaining convex portion 22 in a direction away from the female connector 3, and also the lever 1 is kept in a rotation movement-disenabling condition with a clearance Y formed between a lower end portion 18*a* of the temporary-retaining piece portion 13 and an upper end portion of the temporary-retaining convex portion 22.

Then, when the male connector 2 and the lever 1 are inserted into a position to which they can be inserted by their own weights, a tapering portion 35*a* of a release plate portion 35 abuts against the temporary-retaining piece portion 13. In this condition, when a manipulating portion 14 is pressed toward the female connector 3, a distal end portion of the release plate portion 35 is brought into contact with the inner side of the temporary-retaining piece portion 13, and causes this temporary-retaining piece portion 13 to slide over the temporary-retaining convex potion 22. As a result, the rotation movement-disenabling condition of the lever 1 is canceled. Then, in this condition, the manipulating portion 14 is further pressed toward the female connector 3, and by doing so, the lever 1 is pivotally moved, and the angular portion 12*a* abuts against an edge wall 38 to serve as a fulcrum, and also boss portion-receiving holes 11*a* and 11*b* serve as a point of application, and boss portions 21*a* and 21*b* are pressed into the inner part of the fitting space in the fitting direction K, and the terminals in the male connector 2 are electrically connected respectively to the terminals in the female connector 3.

In the above lever fitting type connector 10, there are occasions when the male connector 2 and the female connector 3 fail to be completely fitted together, and are kept in a half-fitted condition (see FIG. 3) for some reason (for example, when wires 4 are caught by something). When the wires 4 connected to the male connector 2 are pulled in order to cancel this half-fitted condition so as to return the lever fitting type connector into a condition in which the terminals of the male connector 2 are not electrically connected to the terminals of the female connector 3, the angular portion 12*a* abuts against the edge wall 38, and the lever 1 is pivotally moved, and the lever 1 and the male connector 2 are moved away from the female connector 3.

This rotation movement of the lever 1 is stopped when the amount of overlapping of the fulcrum projection 12 and the edge wall 38 in a direction (that is, a perpendicularly-intersecting direction) perpendicular to the fitting direction K becomes zero (0), and therefore the lever 1, the male connector 2 and the female connector 3 are formed such that when this overlapping amount becomes zero, the temporary-retaining piece portion 13 is returned to the position where it is spaced from the temporary-retaining convex portion 22 in the direction away from the female connector 3, and by doing so, the lever 1 can be returned into the rotation movement-disenabling condition without fail even when the half-fitted condition of the male and female connectors 2 and 3 is canceled by any means.

Namely, in order to provide "the lever fitting type connector 10 in which even when the half-fitted condition of the male and female connectors 2 and 3 is canceled by any means, the lever 1 can be returned into the rotation movement-disenabling condition without fail", it is necessary to meet a requirement that "when canceling the above half-fitted condition by pulling the wires 4, a clearance formed between the temporary-retaining piece portion 13 and the temporary-retaining convex portion 22 in the fitting direction K should be larger than zero (0) while the amount of overlapping of the fulcrum projection 12 and the edge wall 38 is zero (0), that is, a clearance formed between the fulcrum projection 12 and the edge wall 39 in the above perpendicularly-intersecting direction is zero (0)".

In the lever fitting type connector 10 of the invention, the lever 1 is pivotally moved about an axis P shown in FIG. 5. Therefore, when the distance between the axis P of rotation movement of the lever 1 and the angular portion 12*a* of the fulcrum projection 12 is represented by a, a path of movement of the angular portion 12*a* in accordance with the rotation movement of the lever 1 lies on a circle A having a radius a and also having its center disposed on the axis P. Further, when the distance between the axis P of rotation movement of the lever 1 and the lower end portion 18*a* of the temporary-retaining piece portion 13 is represented by b, a path of movement of the lower end portion 18*a* in accordance with the rotation movement of the lever 1 lies on a circle B having a radius b and also having its center disposed on the axis P. When the angle of rotation of the lever 1 from the position where the angular portion 12*a* abuts against the edge wall 38 to the position shown in FIG. 5 is represented by θ, and the amount of movement of the angular portion 12*a* (along its movement path) in accordance with the rotation movement of the lever 1 through the angle θ is represented by x, and the amount of movement of the lower end portion 18*a* (along its movement path) in accordance with the rotation movement of the lever 1 through the angle θ is represented by y, the following formula is established.

$$x \times b = y \times a \qquad \text{Formula 1}$$

It will be appreciated from FIG. 5 that "the dimension of the clearance formed between the fulcrum projection 12 and the edge wall 39 in the above perpendicularly-intersecting direction" in FIG. 5 is approximate to "the amount x of movement the angular portion 12*a* (along its movement path) in accordance with the rotation movement of the lever 1 through the angle θ" and that "the dimension of the clearance formed between the temporary-retaining piece portion 13 and the temporary-retaining convex portion 22 in the fitting direction K" in FIG. 5 is approximate to "the amount y of movement of the lower end portion 18*a* (along its movement path) in accordance with the rotation movement of the lever 1 through the angle θ". Therefore, in order to meet the requirement that "the clearance formed between the temporary-retaining piece portion 13 and the temporary-retaining convex portion 22 in the fitting direction K should be larger than zero (0) while the clearance formed between the fulcrum projection 12 and the edge wall 39 in the above perpendicularly-intersecting direction is zero (0)", it is only necessary that the lever fitting type connector 10 should satisfy the following formula.

(The dimension of the clearance formed between the fulcrum projection 12 and the edge wall 39 in the perpendicularly-intersecting direction)$\times b <$(The dimension of the clearance formed between the temporary-retaining piece portion 13 and the temporary-retaining convex portion 22 in the fitting direction $K$)$\times a$ Formula 2

In the lever fitting type connector 10 of the invention, as described above, in the condition in which the fulcrum projection 12 is located in the fulcrum projection guide groove 36, the clearance X is formed between the angular portion 12*a* and the edge wall 39, and also the clearance Y is formed between the lower end portion 18*a* and the upper end portion of the temporary-retaining convex portion 22. Therefore, when the lever fitting type connector 10 of the invention satisfies the following formula, the lever 1 can be returned into the rotation movement-disenabling condition without fail even if the half-fitted condition of the male and female connectors 2 and 2 is canceled by any means.

$$X \times b < Y \times a \qquad \text{Formula 3}$$

Thus, it has become clear that in order to provide the lever fitting type connector 10 in which even when the half-fitted condition of the male and female connectors 2 and 3 is canceled by any means, the lever 1 can be returned into the rotation movement-disenabling condition without fail, this lever fitting type connector 10 need only to satisfy the formula, (X×b<Y×a) (Formula 3).

In the invention, the lever 1 can be returned into the rotation movement-disenabling condition without fail even when the half-fitted condition of the male and female connectors is canceled by any means, and therefore this lever fitting type connector can be handled easily, and also damage to this lever fitting type connector can be prevented.

BRIEF DESCRIPTION OF THE DRAWINGS

The above objects and advantages of the present invention will become more apparent by describing in detail preferred exemplary embodiments thereof with reference to the accompanying drawings, wherein:

FIG. 2A shows an initial stage of the operation for fitting male and female connectors together, and FIG. 2B shows the positional relation between a temporary-retaining piece portion of a lever and a temporary-retaining convex portion of the male connector shown in FIG. 2A, and FIG. 2C shows the positional relation of a fulcrum projection of the lever to a fulcrum projection guide groove and a fulcrum projection-receiving groove of the female connector shown in FIG. 2A;

FIG. 3A shows a half-fitted condition of the male and female connectors, and FIG. 3B shows the positional relation between the temporary-retaining piece portion of the lever and the temporary-retaining convex portion of the male connector shown in FIG. 3A, and FIG. 3C shows the positional relation of the fulcrum projection of the lever to the fulcrum projection guide groove and the fulcrum projection-receiving groove of the female connector shown in FIG. 3A;

FIG. 4A shows a process of canceling the half-fitted condition of the male and female connectors, and FIG. 4B shows the positional relation between the temporary-retaining piece portion of the lever and the temporary-retaining convex portion of the male connector shown in FIG. 4A, and FIG. 4C shows the positional relation of the fulcrum projection of the lever to the fulcrum projection guide groove and the fulcrum projection-receiving groove of the female connector shown in FIG. 4A;

FIG. 6A shows an initial stage of an operation for fitting male and female connectors together, and FIG. 6B shows a half-fitted condition of the male and female connectors, and FIG. 6C shows a process of canceling the half-fitted condition of the male and female connectors.

DETAILED DESCRIPTION OF EXEMPLARY EMBODIMENTS

Figure 1:
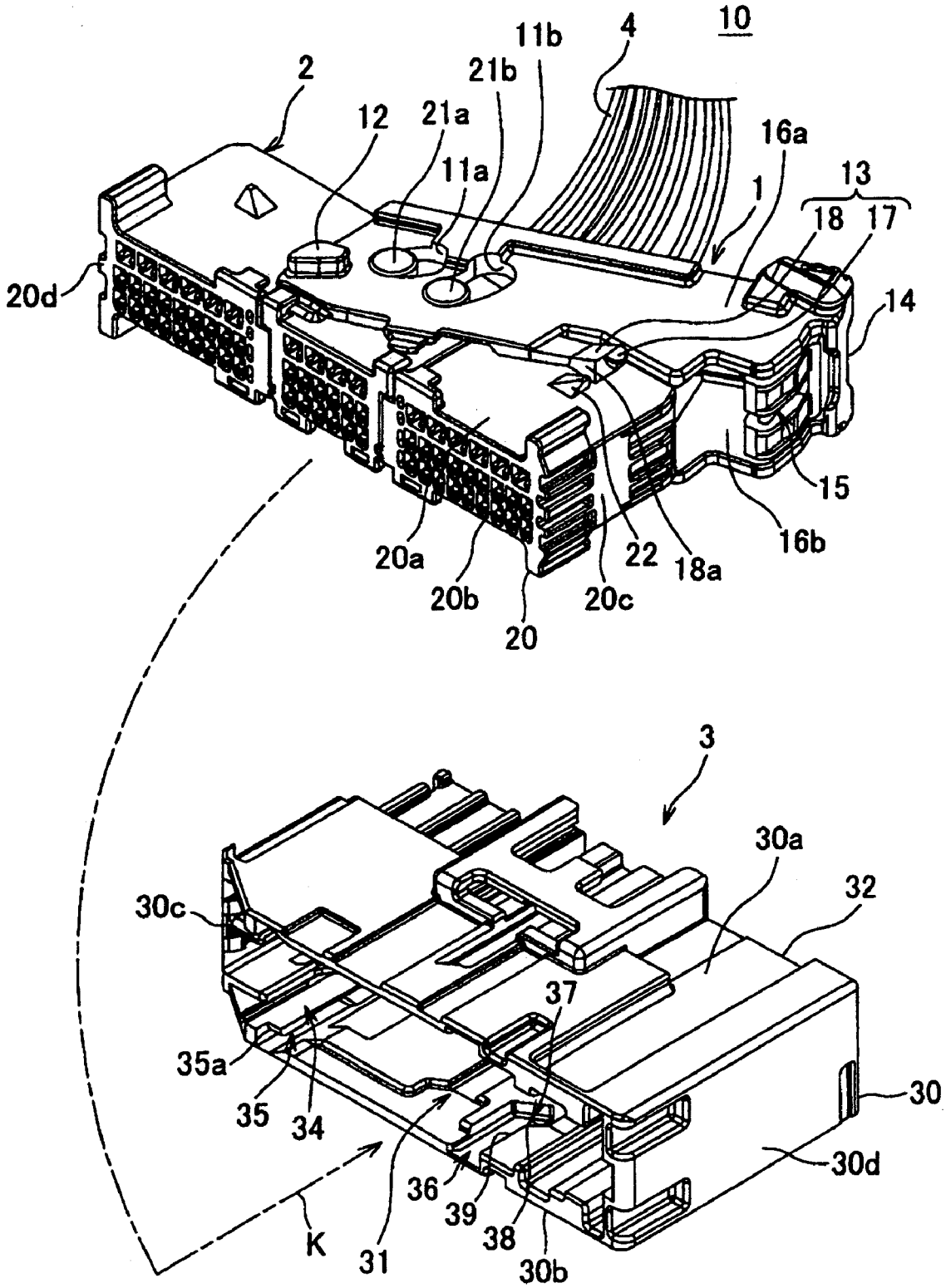
FIG. 1 is a perspective view showing one preferred embodiment of a lever fitting type connector of the present invention.

One preferred embodiment of a lever fitting type connector 10 of the present invention will now be described with reference to FIGS. 1 to 5.

The lever fitting type connector 10 of this embodiment shown in FIG. 1 comprises a male-type connector (hereinafter referred to as "male connector") 2, a lever 1 pivotally mounted on a connector housing 20 of the male connector 2, and a female-type connector (hereinafter referred to as "female connector") 3 including a connector housing 30 having a fitting space 31 for the insertion of the male connector 2 therein. In this lever fitting type connector 10, when the lever 1 is pivotally moved toward the female connector 3, the male connector 2 is pushed in a fitting direction K into an inner part of the fitting space 31, and is fitted to the female connector 3. When the lever 1 is pivotally moved in a direction away from the female connector 3, the male connector 2 is separated from the female connector 3, thus canceling the fitted condition.

As shown in FIG. 1, the male connector 2 includes the connector housing 20 of a rectangular shape made of an insulative synthetic resin, and female terminals received in the connector housing 20. The connector housing 20 includes a pair of opposed side faces 20*a* and 20*b*, an interconnecting face 20*c* interconnecting one ends of the two side faces 20*a* and 20*b*, and an interconnecting face 20*d* interconnecting the other ends of the two side faces 20*a* and 20*b*. Two cylindrical boss portions 21*a* and 21*b* are formed on a center portion (in a longitudinal direction) of each side face 20*a*, 20*b*, and are spaced from each other. The longitudinal direction is perpendicular to the fitting direction K shown in FIG. 1. A pair of temporary-retaining convex portions 22 are formed on and project respectively from opposite end portions (spaced from each other in the longitudinal direction) of each side face 20*a*, 20*b*.

The lever 1 is made of an insulative synthetic resin, and includes a pair of parallel side plates 16*a* and 16*b* having their one end portions spaced from each other, and a manipulating portion 14 interconnecting the other end portions of the two side plates 16*a* and 16*b*. The manipulating portion 14 is a portion to which a load is applied when pivotally moving the lever 1, that is, serves as a load-applying point of the lever 1. A lock arm 15 is formed on the manipulating portion 14, and when the male connector 2 is completely fitted in the female connector 3, the lock arm 15 is retainingly engaged with the connector housing 30 of the female connector 3. The lock arm 15, when retainingly engaged with the connector housing 30, prevents the lever 1 from being moved even upon application of an accidental external force thereto.

Fulcrum projections 12 are formed respectively on the one end portions of the pair of side plates 16*a* and 16*b*. When the fulcrum projections 12 are received respectively in fulcrum projection-receiving grooves 37 formed in the connector housing 30 of the female connector 3, these fulcrum projections 12 are engaged with the connector housing 30, and serve as a fulcrum for the rotation movement of the lever 1. A pair of boss portion-receiving holes 11*a* and 11*b* receiving the respective boss portions 21*a* and 21*b* are formed in each side plate 16*a*, 16*b*, and are disposed closer to the other end portion thereof than the fulcrum projection 12 is. These boss portion-receiving holes 11*a* and 11*b* serve as a point of application for the lever 1.

A temporary-retaining piece portion 13 is formed at the lower side of the other end portion of each side plate 16*a*, 16*b*. At an initial stage of the fitting operation for fitting the two connectors 2 and 3 together, each temporary-retaining piece portion 13 is located in a position where it is spaced from the temporary-retaining convex portion 22 in the direction away from the female connector 103, thereby disenabling the rotation movement of the lever 1 toward the female connector 3. The temporary-retaining piece portion 13 includes an abutment convex portion 18 having a lower end portion 18*a* for abutting against the temporary-retaining convex portion 22, and an elastic piece portion 17 extending from the abutment convex portion 18 toward the other end portion of the side plate 16*a*, 16*b*. The elastic piece portion 17 is smaller in thickness than the abutment convex portion 18, and can be easily elastically deformed or bent.

As shown in FIG. 1, the female connector 3 is made of an insulative synthetic resin, and includes the female connector housing 30 having the fitting space 31, and male terminals received in the connector housing 30. These male terminals are fitted respectively to the female terminals in the male connector 2.

The connector housing 30 includes a pair of opposed side walls 30*a* and 30*b*, an interconnecting wall 30*c* interconnecting one ends of the two side walls 30*a* and 30*b*, an interconnecting wall 30*d* interconnecting the other ends of the two side walls 30*a* and 30*b*, and a bottom wall 32 (supporting the male terminals) disposed at that side facing away from an opening of the fitting space 31. The side walls 30*a* and 30*b*, the interconnecting walls 30*c* and 30*d* and the bottom wall 32 jointly form the fitting space 31. Two fulcrum projection guide grooves 36 are formed respectively in inner surfaces (inner walls) of the side walls 30*a* and 30*b*, and extend respectively from upper ends (remote from the bottom wall 32) of these inner surfaces to the inner part of the fitting space 31 in the fitting direction K. Also, fulcrum projection-receiving grooves 37 are formed respectively in the inner surfaces of the side walls 30*a* and 30*b*, and extend respectively from lower ends (remote from the above upper ends of the inner surfaces) of the fulcrum projection guide grooves 36 in intersecting relation thereto. Further, plate-like release plate portions 35 are formed respectively at the inner surfaces of the side walls 30*a* and 30*b*.

Each fulcrum projection-receiving groove 37 receives the corresponding fulcrum projection 12 therein at the time of rotation movement of the lever 1, and enables this fulcrum projection 12 to serve as the fulcrum for the lever 1. The fulcrum projection-receiving groove 37 has an edge wall 38 for abutting against an outer edge portion of the fulcrum projection 12 at the time of rotation movement of the lever 1. Each fulcrum projection guide groove 36 is a groove through which the fulcrum projection 12 is moved into the fulcrum projection-receiving groove 37. The fulcrum projection guide groove 36 has an edge wall 39 extending upwardly from the edge wall 38 to the upper end of the inner surface of the side wall 30*a*, 30*b* in the fitting direction K.

When the male connector 2 is moved toward the female connector 3 at the initial stage of the fitting operation, each release plate portion 35 is brought into contact with the inner side of the elastic piece portion 17 to elastically bend this elastic piece portion 17 outwardly (in the direction of juxtaposition of the two side plates 16*a* and 16*b* to each other), so that the abutment convex portion 18 slides over the temporary-retaining convex portion 22 toward the female connector 3. The release plate portions 35 are formed integrally respectively with opposing walls 34 provided in opposed relation respectively to the inner surfaces of the side walls 30*a* and 30*b*. A tapering portion 35*a* is formed at an upper end of the release plate portion 35, and this tapering portion 35*a* is gradually increasing in thickness toward the inner part of the fitting space 31 in the fitting direction K.

Figure 2A:
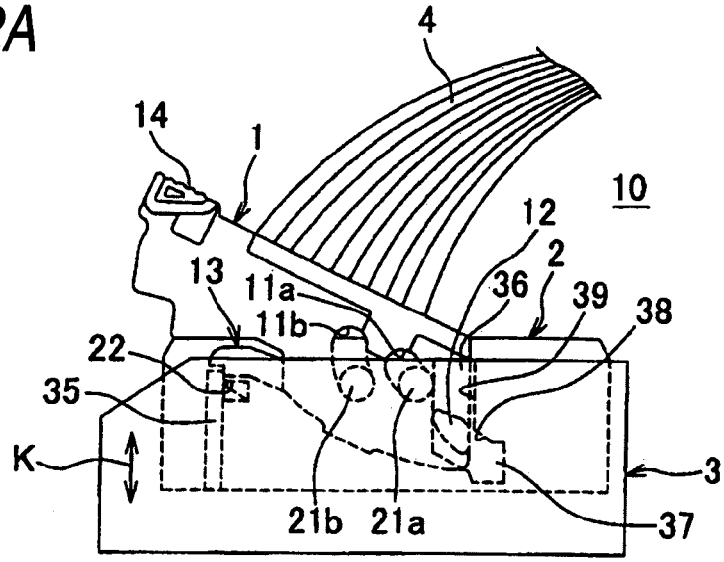
FIGS. 2A to 2C are views explanatory of an operation of the lever fitting type connector of FIG. 1.
Figure 2B:
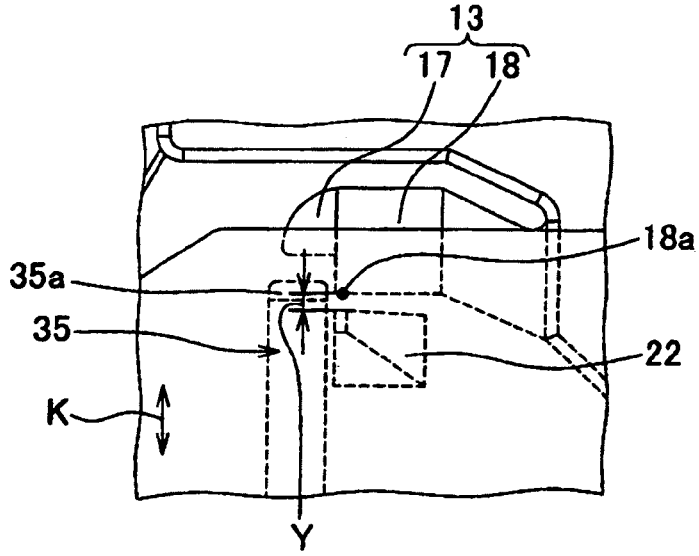
Figure 2C:
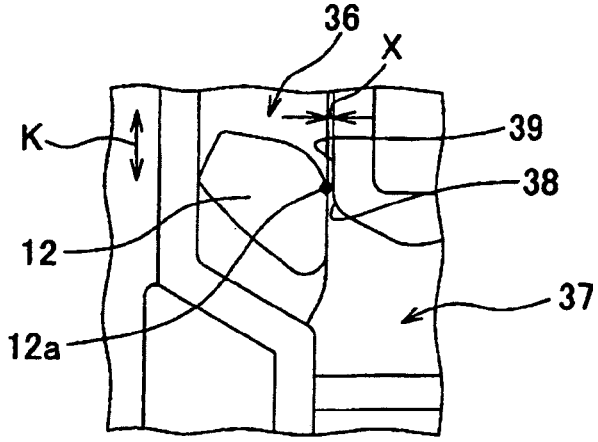

In the lever fitting type connector 10 of the above construction, at the initial stage of the fitting operation, the male connector 2 and the lever 1 (mounted on this male connector 2 and kept in the rotation movement-disenabling condition) are inserted into the fitting space 31 through the opening thereof as shown in FIG. 2A, and also each fulcrum projection 12 is passed to the lower end of the fulcrum projection guide groove 36 through the upper end thereof. At this time, the fulcrum projection 12 is passed, with a clearance X formed between its angular portion 12*a* and the edge wall 39 of the fulcrum projection guide groove 36 as shown in FIG. 2C. Namely, "a clearance formed between the fulcrum projection 12 and that edge wall 39 of the fulcrum projection guide groove 36 disposed close to the fulcrum projection-receiving groove 37" means "the clearance formed between the angular portion 12*a* and the edge wall 39 in a direction (that is, a perpendicularly-intersecting direction) perpendicular to the fitting direction K". At the time when the fulcrum projection 12 is passed through the fulcrum projection guide groove 36, the abutment convex portion 18 is located in the position where it is spaced from the temporary-retaining convex portion 22 in the direction away from the female connector 3, and the lever 1 is kept in the rotation movement-disenabling condition with a clearance Y formed between the lower end portion 18*a* of the abutment convex portion 18 and the temporary-retaining convex portion 22 as shown in FIG. 2B. Namely, "a clearance formed between the temporary-retaining piece portion 13 and the temporary-retaining convex portion 22" means "the clearance formed between the lower end portion 18*a* and the upper end portion of the temporary-retaining convex portion 22 in the fitting direction K".

In the lever fitting type connector 10 of this invention, the above-mentioned formula 3, that is, $[X \times b < Y \times a]$, is established where a represents the distance between the axis P of rotation of the lever 1 and the angular portion 12*a* of the fulcrum projection 12, and b represents the distance between the axis P of rotation of the lever 1 and the lower end portion 18*a* of the abutment convex portion 18.

"The angular portion 12*a*" is that portion of the outer edge of the fulcrum projection 12 which is disposed closest to the one end of the lever 1 and has a gently-angular shape in a plan view, and this angular portion 12*a* is first brought into abutting engagement with the edge wall 38 when the lever 1 is pivotally moved.

Then, when the male connector 2 and the lever 1 are inserted into a position to which they can be inserted by their own weights, the tapering portion 35*a* of the release plate portion 35 abuts against the elastic piece portion 17. In this condition, when the manipulating portion 14 is pressed toward the female connector 3, the tapering portion 35*a* is brought into contact with the inner side of the elastic piece portion 17 to elastically bend this elastic piece portion 17 outwardly, so that the abutment convex portion 18 slides over the temporary-retaining convex portion 22. As a result, the rotation movement-disenabling condition of the lever 1 is canceled. When the rotation movement-disenabling condition of the lever 1 is thus canceled, the fulcrum projection 12 is located in the fulcrum projection-receiving groove 37.

Figure 3A:
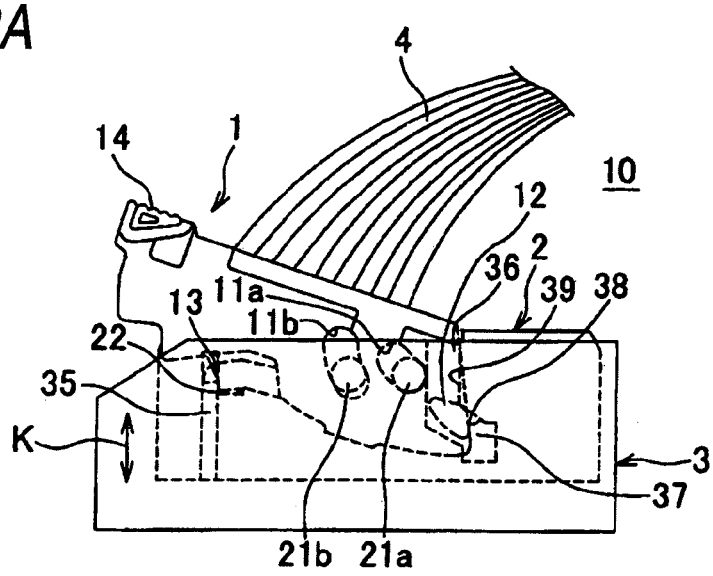
FIGS. 3A to 3C are views explanatory of the operation of the lever fitting type connector of FIG. 1.
Figure 3B:
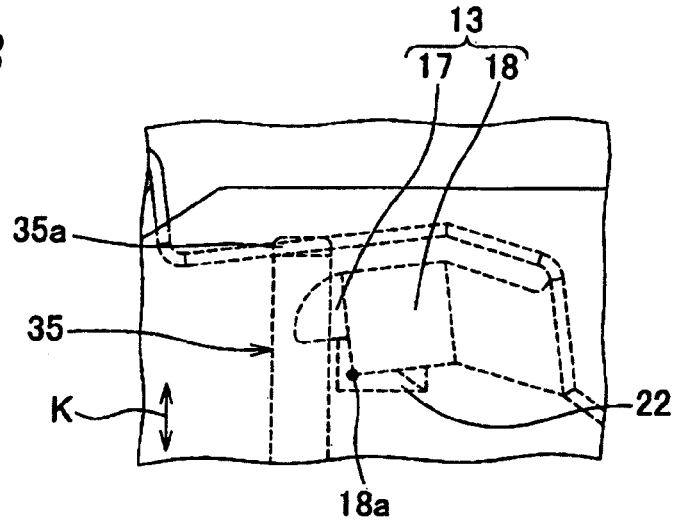
Figure 3C:
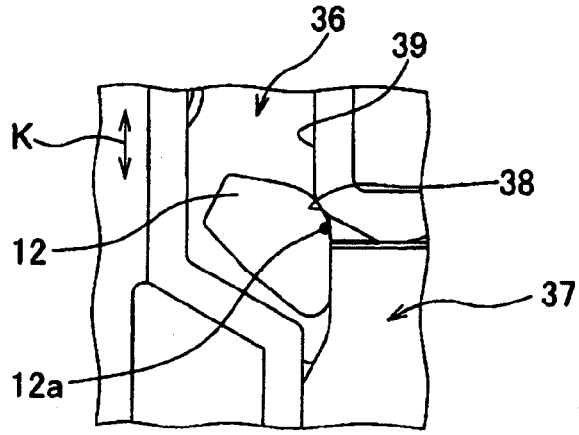

In the invention, "the condition in which the fulcrum projection 12 is located in the fulcrum projection-receiving groove 37" means the condition in which the angular portion 12*a* of the fulcrum projection 12 is spaced from the edge wall 38 toward the lower side (that is, toward the bottom wall 32) in the fitting direction K as shown in FIG. 3C.

Then, in the condition in which the rotation movement-disenabling condition of the lever 1 is canceled, the manipulating portion 14 is further pressed toward the female connector 3, and by doing so, the lever 1 is pivotally moved, and the angular portion 12*a* abuts against the edge wall 38 to serve as the fulcrum, and also the boss portion-receiving holes 11*a* and 11*b* serve as the point of application, and the boss portions 21*a* and 21*b* and hence the connector housing 20 are pressed into the inner part of the fitting space 31 in the fitting direction K. As a result, the terminals of the male connector 2 are electrically connected respectively to the terminals of the female connector 3.

Then, in the completely-fitted condition of the male and female connectors 2 and 3 in which the bottom surface of the connector housing 20 abuts against the bottom wall 32 of the connector housing 30, the lock arm 15 is retainingly engaged with the connector housing 30, and by doing so, the fitted condition of the male and female connectors 2 and 3, as well as the electrically-connected condition of the terminals of the male and female connectors 2 and 3, is maintained.

For canceling the fitted condition of the male and female connectors 2 and 3, the retained condition of the lock arm 15 is canceled by the hand or any other suitable means, and then the manipulating portion 14 is pressed to be moved away from the female connector 3. As a result, the outer edge portion of the fulcrum projection 12 abuts against the edge wall 38, and the lever 1 is pivotally moved, and therefore the lever 1 and the male connector 2 are moved away from the female connector 3, and the terminals of the male connector 2 are electrically disconnected from the respective terminals of the female connector 3, and thus the lever 1 and the male connector 2 are returned to the position of the initial stage of the fitting operation in which the fulcrum projection 12 is received or located in the fulcrum projection guide groove 36. In this condition in which the fulcrum projection 12 moved from the fulcrum projection-receiving groove 37 into the fulcrum projection guide groove 36 is thus located in this fulcrum projection guide groove 36, the abutment convex portion 18 is returned to the position where the abutment convex portion 18 is spaced from the temporary-retaining convex portion 22 in the direction away from the female connector 3.

"To cancel the fitted condition of the male and female connectors 2 and 3" means "to separate the terminals of the male connector 2 from the terminals from the female connector 3 to thereby electrically disconnect the terminals of the male connector 2 from the terminals of the female connector 3".

In the lever fitting type connector 10, there are occasions when the male connector 2 and the female connector 3 fail to be completely fitted together, and are kept in a half-fitted condition as shown in FIG. 3A for some reason (for example, when the wires 4 are caught by something). "The half-fitted condition" means the condition in which the rotation movement-disenabling condition of the lever 1 is canceled as shown in FIG. 3B, and the terminals of the male connector 2 are electrically connected respectively to the terminals of the female connector 2, and the fulcrum projection 12 is located in the fulcrum projection-receiving groove 37, and the lock arm 15 is not retainingly engaged with connector housing 30.

Such a half-fitted condition can be canceled by pressing the manipulating portion 14 away from the female connector 3 or by pulling the wires 4 connected to the connector housing 20 as described above, and by doing so, the terminals of the male connector 2 are again electrically disconnected from the respective terminals of the female connector 3. "To cancel the half-fitted condition of the male and female connectors 2 and 3" means to separate the terminals of the male connector 2 from the terminals of the female connector 3 (which have been electrically connected to the terminals of the male connector 2 in the half-fitted condition) to thereby electrically disconnect the terminals of the male connector 2 from the terminals of the female connector 3.

Figure 4A:
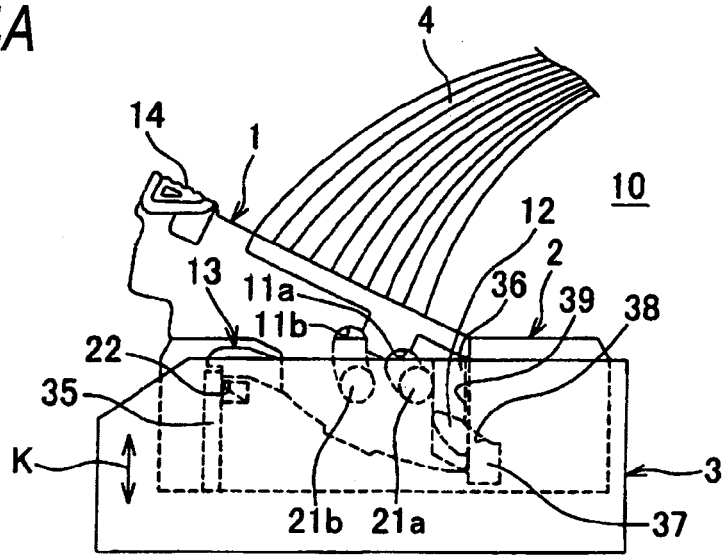
FIGS. 4A to 4C are views explanatory of the operation of the lever fitting type connector of FIG. 1.
Figure 4B:
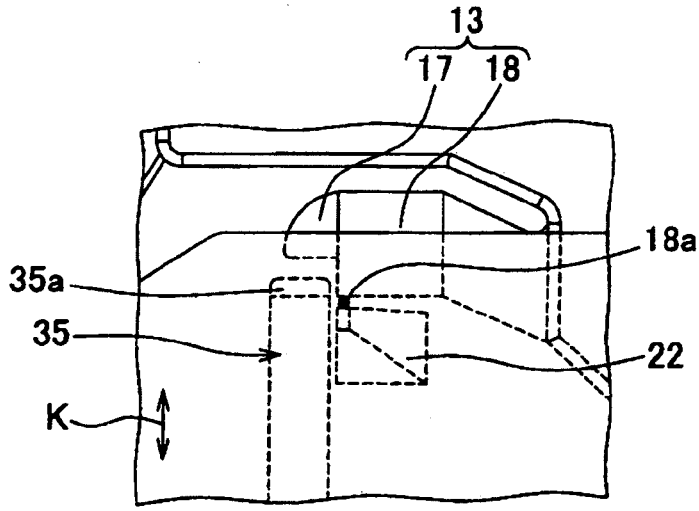
Figure 4C:
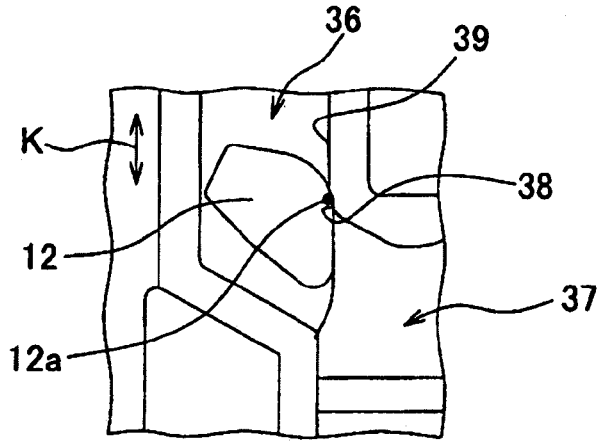
Figure 5:
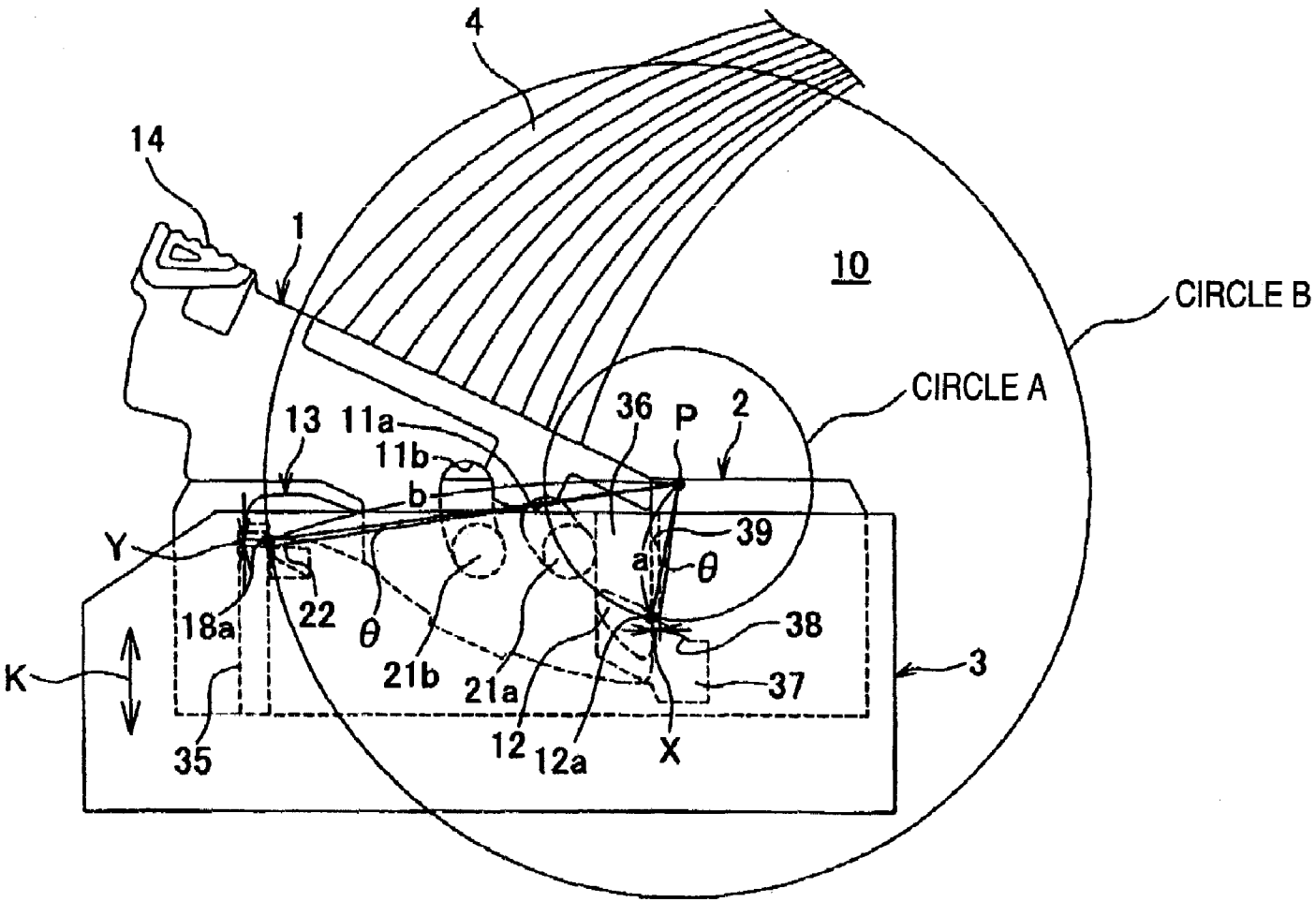
FIG. 5 is a view explanatory of dimensions of the lever fitting type connector of FIG. 1.
Figure 6A:
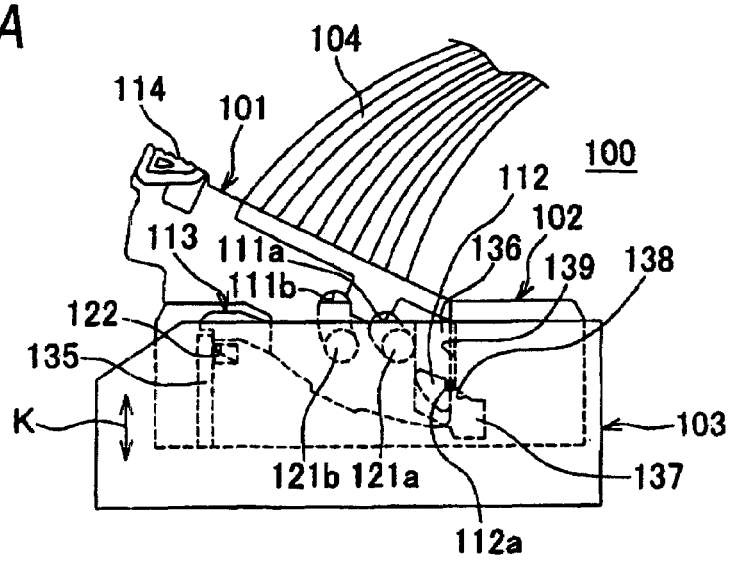
FIG. 6A to 6C are views explanatory of an operation of a conventional lever fitting type connector.
Figure 6B:
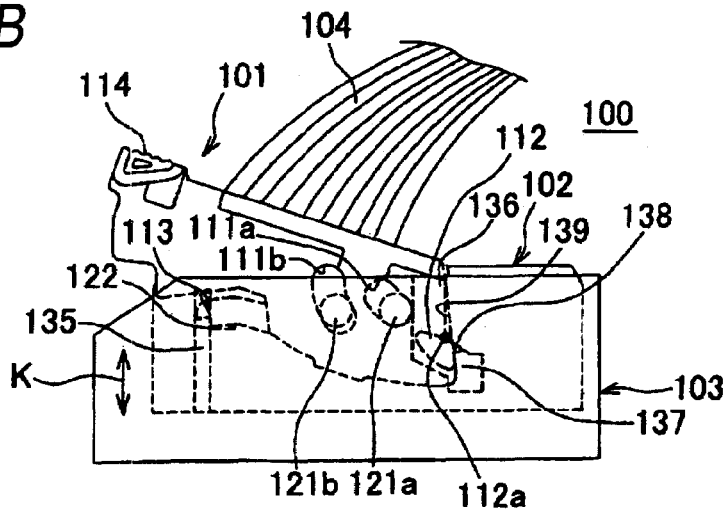
Figure 6C:
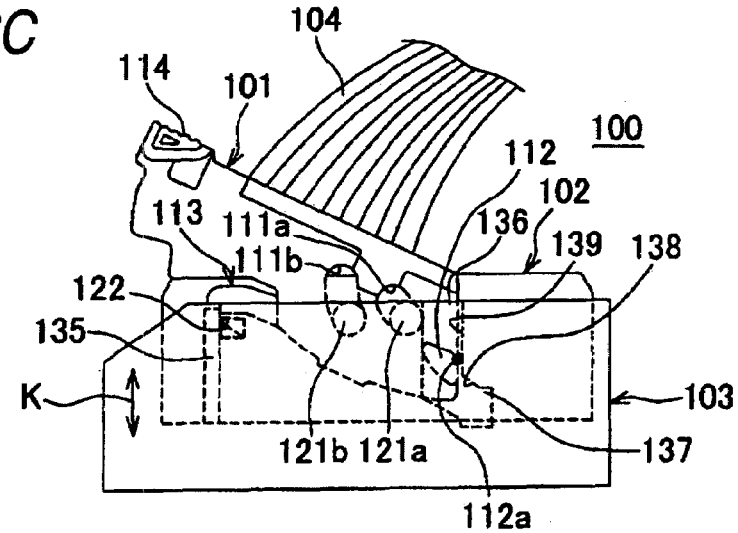

In the above half-fitted condition, when the wires 4 are pulled in order to cancel this half-fitted condition, the outer edge portion of the fulcrum projection 12 abuts against the edge wall 38, and the lever 1 is pivotally moved, and the lever 1 and the male connector 2 are moved away from the female connector 3, and the terminals of the male connector 2 are electrically disconnected respectively from the terminals of the female connector 3. When the outer edge portion of the fulcrum projection 12 is to be separated from the edge wall 38 as shown in FIGS. 4A and 4C, the abutment convex portion 18 is returned to the position where the abutment convex portion 18 is spaced from the provisionally-convex portion 22 in the direction away from the female connector 3 as shown in FIGS. 4A and 4B. Therefore, when the fulcrum projection 12 is moved from the fulcrum projection-receiving groove 37 into the fulcrum projection guide groove 36, and is located in this fulcrum projection guide groove 36, the abutment convex portion 18 never fails to be returned to the position where the abutment convex portion 18 is spaced from the temporary-retaining convex portion 22 in the direction away from the female connector 3.

Then, in this condition (in which the half-fitted condition is canceled, and the fulcrum projection 12 is returned to the fulcrum projection guide groove 36), when the manipulating portion 14 is again pressed to effect the fitting operation, the release plate portion 35 causes the abutment convex portion 18 to slide over the temporary-retaining convex portion 22, and then the outer edge portion (that is, the angular portion 12*a*) of the fulcrum projection 12 abuts against the edge wall 38, and the lever 1 begins to be pivotally moved at a proper timing, and the male connector 2 is properly fitted into the female connector 3.

In the above half-fitted condition, when the manipulating portion 14 is pressed to be moved away from the female connector 3 in order to cancel this half-fitted condition, the outer edge portion of the fulcrum projection 12 abuts against the edge wall 38, and the lever 1 is pivotally moved as in the operation for cancelling the completely-fitted condition of the male and female connectors 2 and 3, and the lever 1 and the male connector 2 are moved away from the female connector 3, and the terminals of the male connector 2 are electrically disconnected respectively from the terminals of the female connector 3, and the lever 1 and the male connector 2 are returned to the position of the initial stage of the fitting operation in which the fulcrum projection 12 is received or located in the fulcrum projection guide groove 36.

As described above, in the present invention, the lever 1, the male connector 2 and the female connector 3 are formed such that the formula, $(X \times b < Y \times a)$, is established, and therefore even when the half-fitted condition of the male and female connectors 2 and 3 is canceled by any means, the lever 1 can be returned into the rotation movement-disenabling condition without fail. Therefore, this lever fitting type connector 10 can be handled easily, and also damage to this lever fitting type connector 10 can be prevented.

The above embodiment merely shows a typical form of the invention, and the present invention is not limited to the above embodiment. Namely, various modifications can be made without departing from the subject matter of the invention.

The present application is based on Japan Patent Application No. 2008-028604 filed on Feb. 8, 2008, the contents of which are incorporated herein for reference.

What is claimed is:

1. A lever fitting type connector, comprising:

a male connector;

a lever which is rotatably attached to the male connector; and a female connector which has a fitting space into which the male connector is inserted, wherein an inner wall forming the fitting space of the female connector has a guiding groove portion and a receiving groove portion for receiving a fulcrum projection formed at one end portion of the lever;

wherein when the lever is rotatably moved by pressing a manipulating portion at the other end portion of the lever toward the female connector in a condition that the fulcrum projection is located in the receiving groove portion, the male connector is pressed into the inside of the fitting space in a fitting direction to be fitted into the female connector, with the fulcrum projection serving as a fulcrum and with a center portion serving as an action point;

wherein when the manipulating portion is pressed so as to be away from the female connector or wires connected to the male connector are pulled in a half-fitted condition of the lever fitting type connector, the lever fitting type connector is returned into a non-fitted condition in which terminals of the male connector are not electrically connected to terminals of the female connector;

wherein the guiding groove portion extends in the fitting direction from an upper end portion of the inner wall toward the inside of the fitting space;

wherein the receiving groove portion is communicated with the guiding groove portion and extends in a direction intersecting the fitting direction from one end of the guiding groove portion which is away from the upper portion of the inner wall;

wherein a temporary-retaining portion is formed on the lever, and a temporary-retaining convex portion is formed on the side face of the male connector, and at an initial process of the fitting operation, the temporary-retaining portion is spaced from the temporary-retaining convex portion in a direction away from the female connector for restricting the rotation movement of the lever toward the female connector;

wherein a release portion is formed on the inner wall, and when the male connector is moved toward the female connector, the release portion is brought into contact with an inner side of the temporary-retaining portion to bend the temporary-retaining portion outwardly so that the temporary-retaining portion slide over the temporary-retaining convex portion toward the female connector to release an unrotatalbe condition of the lever; and wherein in a condition in which the fulcrum projection is located in the guide groove portion at the initial process of the fitting operation, a clearance represented by X is formed between the fulcrum projection and an edge wall of the guide groove portion disposed close to the receiving groove portion, and a clearance represented by Y is formed between the temporary-retaining portion and the temporary-retaining convex portion, and the formula, $(X \times b < Y \times a)$, is established where a represents the distance between an axis of rotation movement of the lever and the fulcrum projection, and b represents the distance between the axis of rotation movement of the lever and the temporary-retaining portion.

* * * * *